United States Patent [19]

Serge

[11] Patent Number: 4,616,568

[45] Date of Patent: Oct. 14, 1986

[54] PROJECTILES INTENDED TO BE FIRED BY A FIRE-ARM

[76] Inventor: Ladriere Serge, Avenue du Cap Roux, 06360 Eze sur Mer, France

[21] Appl. No.: 634,102

[22] PCT Filed: Nov. 24, 1983

[86] PCT No.: PCT/FR83/00227

§ 371 Date: Jul. 20, 1984

§ 102(e) Date: Jul. 20, 1984

[87] PCT Pub. No.: WO84/02182

PCT Pub. Date: Jun. 7, 1984

[30] Foreign Application Priority Data

Nov. 24, 1983 [FR] France ..... 82 19659

[51] Int. Cl.[4] ..... F42B 11/00

[52] U.S. Cl. ..... 102/501

[58] Field of Search ..... 102/501, 514–519, 102/430

[56] References Cited

U.S. PATENT DOCUMENTS

| | | | |
|---|---|---|---|
| 1,021,685 | 3/1912 | Knaebel | 102/430 |
| 3,157,126 | 11/1964 | Blondeau | 102/501 |
| 3,877,381 | 4/1975 | McCoy | 102/501 |
| 4,005,660 | 2/1977 | Pichard | 102/501 |
| 4,405,100 | 9/1983 | Daniels | 102/501 |

FOREIGN PATENT DOCUMENTS

| | | | |
|---|---|---|---|
| 393079 | 12/1908 | France | 102/501 |
| 512809 | 2/1921 | France . | |
| 43237 | 11/1965 | German Democratic Rep. | 102/501 |
| 22711 | of 1859 | United Kingdom | 102/501 |
| 2236 | of 1911 | United Kingdom . | |
| 1524743 | 9/1978 | United Kingdom . | |

*Primary Examiner*—Harold J. Tudor

*Attorney, Agent, or Firm*—Larson & Taylor

[57] ABSTRACT

A projectile intended to be fired by a firearm comprising a rear portion of general cylindrical configuration whose diameter determines the gauge of the projectile and a front portion of general conical configuration ending in a front point. The front portion has, between the front point and the rear portion, a curved front hollow zone joined to the front point, a curved rear hollow zone connected to the rear portion, these two hollow zones being joined together by at least one curved bulge zone.

8 Claims, 1 Drawing Figure

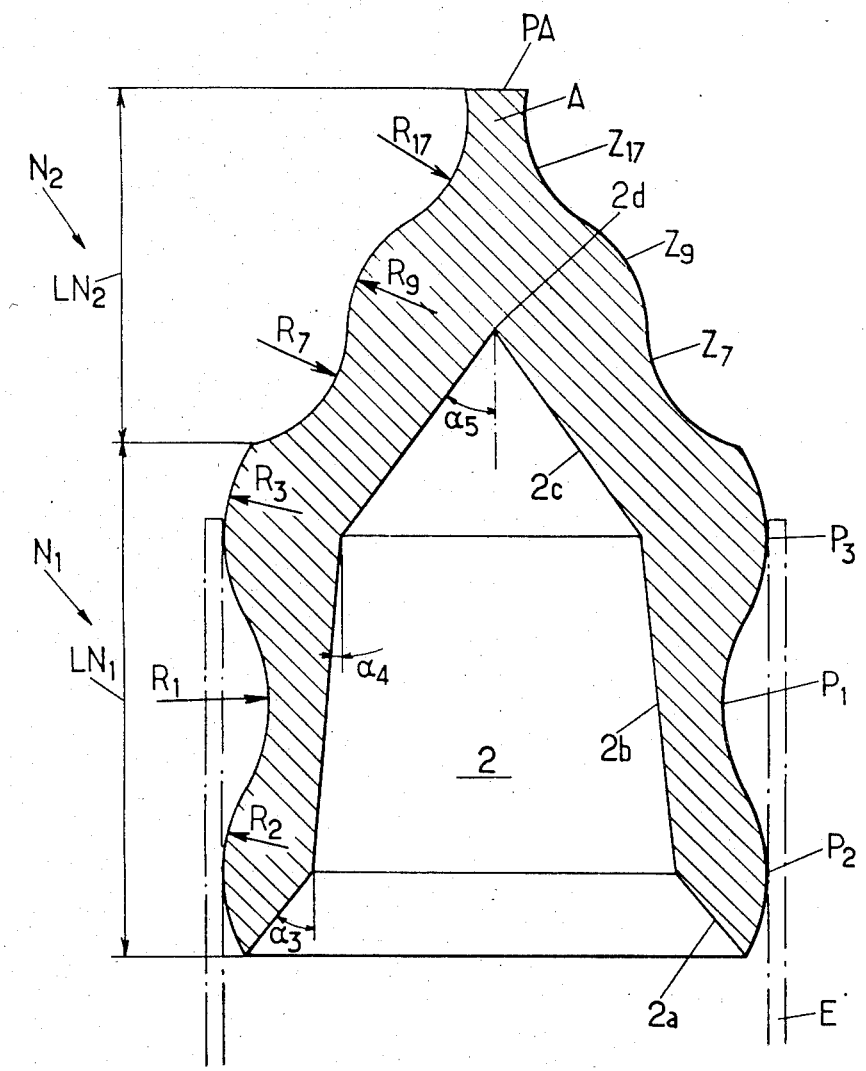
PA
A
$R_{17}$
$Z_{17}$
$N_2$
2d
$Z_9$
$LN_2$
$R_9$
$R_7$
$Z_7$
$\alpha_5$
$R_3$
2c
$P_3$
$N_1$
$LN_1$
$R_1$
$\alpha_4$
$P_1$
2b
2
$R_2$
$P_2$
$\alpha_3$
2a
E

PROJECTILES INTENDED TO BE FIRED BY A FIRE-ARM

FIELD OF THE INVENTION

The invention relates to projectiles intended to be fired by a firearm comprising a rear portion whose diameter determines the gauge of the projectile and a front portion of general conical configuration ending in a front point.

BACKGROUND OF THE INVENTION

Projectiles of this type known up to present had a front portion of general conical configuration and of simple shape which could be conical, ogival with a convex curvature, or ogival with a concave curvature. The shock effects on penetration of such a projectile were limited, which restricted the stopping power of the projectile.

SUMMARY OF THE INVENTION

According to the invention the projectile has increased shock effects with respect to conventional projectiles, because the front portion of the projectile has, between the front point and the rear portion, a front hollow zone connected to the front portion, a rear hollow zone connected to the rear portion. These two hollow zones are joined together by an intermediate zone formed by at least one bulging zone.

This arrangement makes possible, on penetration, a first shock effect produced by the bulge zone and a second shock effect produced by the rear hollow zone at the level of its connection with the rear portion of the projectile.

Furthermore, the bulge zone, situated between the two hollow zones, facilitates the use of a round of ammunition equipped with such a projectile in an automatic, semi-automatic or repeating weapon. In fact, said bulge zone facilitates the introduction of the ammunition in the chamber of the weapon, by cooperating with the access ramp to said chamber.

Advantageously, the rear portion comprises a succession of bulges separated by hollows. The diameter of the rear portion at the level of these bulges determines the gauge of the projectile.

Preferably, the radii of the curvature of the hollow zones of the front portion are equal to each other and equal to the radius of curvature of the bulge zone of said front portion. The radii of curvature may have a value equal to a third of the length of the front portion.

Also preferably, the radii of curvature of the bulge of the rear portion are equal to each other and equal to the radius of curvature of the hollows of said rear portion. The radii of curvature may have a value equal to a third of the length of the rear portion.

In a preferred embodiment of the invention, a recess is formed in the rear portion of the projectile and extends as far as its front portion.

The invention may in any case be well understood from the following description as well as the accompanying drawings which complement and which drawing is relative to a preferred embodiment of the invention.

BRIEF DESCRIPTION OF THE DRAWINGS

The single FIGURE of the drawing shows, in axial section, a projectile according to the invention.

DETAILED DESCRIPTION OF THE PREFERRED EMBODIMENT

This projectile has a rear portion $N_1$, whose diameter determines the gauge of the projectile, and a front portion $N_2$ of general conical configuration and ending in a front point A.

The front portion $N_2$ has, between the front point A and the rear portion $N_1$, a front hollow zone $Z_{17}$ connected to the front point A, a rear hollow zone $Z_7$ connected to the rear portion $N_1$. These two hollow zones $Z_{17}$ and $Z_7$ are connected together by an intermediate zone formed by at least one bulge zone $Z_9$.

The connection of this bulge zone $Z_9$ with the rear hollow zone $Z_7$ may be situated at two thirds of the length $LN_2$ of the front portion $N_2$, from the end of the front point A.

Advantageously, the rear portion $N_1$ may comprise a succession of bulges $P_3$,$P_2$ separated by hollows $P_1$. The diameter of the rear portion $N_1$, at the level of these bulges $P_3$, $P_2$, determines the gauge of the projectile.

Preferably, the radii of curvature $R_{17}$, $R_7$ of the hollow zones $Z_{17}$,$Z_7$ of the front portion $N_2$ are equal to each other and equal to the radius of curvature $R_9$ of the bulge zone $Z_9$ of said front portion $N_2$. Also, these radii of curvature $R_{17}$, $R_7$,$R_9$ preferably have a value which is equal to a third of the length $LN_2$ of the front portion $N_2$.

Preferably also, the radii of curvature $R_3$,$R_2$ of the bulges $P_3$,$P_2$, of the rear portion $N_1$ are equal to each other and equal to the radius of curvature $R_1$ of the hollow $P_1$ of said rear portion $N_1$. These radii of curvature $R_3$,$R_2$,$R_1$ further preferably have a value which is equal to a third of the length $LN_1$ of the rear portion $N_1$.

In the embodiment of the invention illustrated, a recess 2 is formed in the rear portion $N_1$ and extends as far as the front portion $N_2$.

This recess 2 is formed by a rear truncated cone *2a* with angle $\alpha_3$, by an intermediate truncated cone *2b* with angle $\alpha_4$ and by a front cone *2c* with angle $\alpha_5$. The apex *2d* of this front cone *2c* is situated in the front portion $N_2$, approximately at the level of its bulge zone $Z_9$.

The angle $\alpha_3$ is greater than the angle $\alpha_4$.

The angle $\alpha_5$ is less than angle $\alpha_3$ and is greater than the angle $\alpha_4$.

When the projectile of the invention is intended to be crimped to a case E, this crimping is formed at the rear portion $N_1$ on the bulge $P_3$ situated the closest to the front portion $N_2$.

The front point A of the front portion $N_2$ may have a flat face PA or a pointed or rounded end.

I claim:

1. A projectile intended to be fired by a firearm comprising:

a rear portion of generally cylindrical configuration whose diameter determines the gauge of the projectile, and a front portion of generally conical configuration, starting at said rear portion and ending in a front point, wherein said front portion has, between said front point and said rear portion, a curved front hollow zone circumferentially located about said front portion and defined by a radius of curvature joined to said front point, and a curved rear hollow zone circumferentially located about said front portion and defined by a radius of curvature connected to said rear portion, wherein these two said hollow zones are joined together by at least one curved bulge zone circumferentially located about said front portion and defined by at least one radius of curvature, and wherein all of said zones connected together define a continuous surface which in cross-section shows a continuous curve of sinuous shape.

2. The projectile according to claim 1, wherein the radii of curvature of said curved front hollow zone and said curved rear hollow zone of said front portion are equal to each other and equal to the radius of the curvature of said curved bulge zone of said front portion.

3. The projectile according to claim 1, wherein the value of said radii of said hollow zones and bulge zone is equal to a third of the length of said front portion.

4. The projectile according to claim 1, wherein the connection of the curved bulge zone with the curved rear hollow zone is located at two thirds of the length of the front portion, from the end of said front point.

5. The projectile according to claim 1, characterized by the fact that a recess is formed in the rear portion and extends into the front portion.

6. The projectile according to claim 5, characterized by the fact that the recess is formed by a rear truncated cone, by an intermediate truncated cone and by a front cone having an apex, the apex of this front cone being situated in the front portion.

7. The projectile according to claim 6, characterized by that fact that the cone angle of the rear truncated cone is greater than the cone angle of the intermediate truncated cone, and that the cone angle of the front cone is less than the cone angles of both other truncated cones.

8. The projectile according to claim 1, characterized by the fact that the front point of the front portion has a flat face.

* * * * *